US008920196B2

(12) United States Patent
Li et al.

(10) Patent No.: US 8,920,196 B2
(45) Date of Patent: Dec. 30, 2014

(54) ELECTRICAL CONNECTOR FOR REDUCING HIGH FREQUENCY CROSSTALK INTERFERENCES

(75) Inventors: Li-Chen Li, New Taipei (TW); Yi-Hui Hsiao, New Taipei (TW)

(73) Assignee: Concraft Holding Co., Ltd., Grand Cayman (KY)

( * ) Notice: Subject to any disclaimer, the term of this patent is extended or adjusted under 35 U.S.C. 154(b) by 260 days.

(21) Appl. No.: 13/486,740

(22) Filed: Jun. 1, 2012

(65) Prior Publication Data

US 2013/0244495 A1 Sep. 19, 2013

(30) Foreign Application Priority Data

Mar. 19, 2012 (TW) ..... 101109394 A

(51) Int. Cl.
*H01R 13/648* (2006.01)
*H01R 13/6585* (2011.01)

(52) U.S. Cl.
CPC ..... *H01R 13/6585* (2013.01)
USPC ..... 439/607.11

(58) Field of Classification Search
CPC ..... H01R 13/6585
USPC ..... 439/607.05, 607.08, 607.09, 607.11, 439/607.13, 607.15, 541.5, 101, 108
See application file for complete search history.

(56) References Cited

U.S. PATENT DOCUMENTS

| | | | | |
|---|---|---|---|---|
| 6,508,665 | B1 * | 1/2003 | Yeh | 439/541.5 |
| 6,921,291 | B2 * | 7/2005 | Shih | 439/101 |
| 7,484,996 | B2 * | 2/2009 | Ju | 439/541.5 |
| 7,507,115 | B2 * | 3/2009 | Ju | 439/541.5 |

* cited by examiner

*Primary Examiner* — Felix O Figueroa
(74) *Attorney, Agent, or Firm* — Muncy, Geissler, Olds & Lowe, P.C.

(57) ABSTRACT

An electrical connector for reducing high frequency crosstalk interferences is provided to insert with at least two mating elements. The electrical connector includes a first joint, a first signal terminal, a second joint, a second signal terminal and a ground terminal. The first joint and second joint are respectively used to be inserted by the mating elements. The first signal terminal is electrically connected with the mating element inserted within the first joint. The second signal terminal is electrically connected with the mating element inserted within the second joint. The ground terminal is electrically connected with the first joint and the second joint, and disposed between the first signal terminal and the second signal terminal. Signal flow spaces located between the ground terminal and respectively the first signal terminal and second signal terminals are used as signal flow paths for the first signal terminal and second signal terminal respectively.

4 Claims, 21 Drawing Sheets

| | Crosstalk Interference | | |
|---|---|---|---|
| | S1-S2 | S1-S3 | S2-S3 |
| Original (dB) | -30.35 | -48.13 | -46.40 |
| Final (dB) | -50.91 | -56.02 | -46.23 |

FIG. 8

ELECTRICAL CONNECTOR FOR REDUCING HIGH FREQUENCY CROSSTALK INTERFERENCES

CROSS-REFERENCES TO RELATED APPLICATIONS

This non-provisional application claims priority under 35 U.S.C. §119(a) on Patent Application No. 101109394 filed in Taiwan, R.O.C. on Mar. 19, 2012, the entire contents of which are hereby incorporated by reference.

BACKGROUND

1. Technical Field

The disclosure relates to an electrical connector, and more particularly to an electrical connector for reducing high frequency crosstalk interferences.

2. Related Art

Nowadays, various electrical devices such as a television, recorder, video player, CD player, DVD (Digital Video Disc) player etc., are all equipped with plugin connectors to connect with each other for signal transmission.

Generally a connector has multiple signal terminals. When signals are sent through the signal terminals, voltage noise interferences are generated due to electromagnetic coupling between adjacent signal terminals; which is the electromagnetic field interference effect generated within the adjacent areas by interactions of electromagnetic fields induced by different structures, namely "Crosstalk". In other words, crosstalk interferences are incurred between the signal terminals inside the connector. Please refer to FIGS. 1 and 2, which illustrate signal connectors on a conventional connector with the structure and position of a ground terminal; FIG. is a partial perspective view, and FIG. 2 is an explanatory diagram of crosstalk areas. The conventional connector includes signal terminals A1/B1 and ground terminals A2, B2 respectively corresponding to the signal terminals A1, B1. When signals are transmitted through the signal terminal A1, flow spaces are formed between the contact points A11, A12 of the signal terminal A1 and the contact points A21, A22 of the ground terminal A2, such that the signals are transmitted through the path along the contact points A11, A12, A22 and A21. When signals are transmitted through the signal terminal B1, flow spaces are formed between the contact points B11, B12 of the signal terminal B1 and the contact points B21, B22 of the ground terminal B2, such that the signals are transmitted through the path along the contact points B11, B12, B22 and B21. As shown in FIG. 2, if the flow spaces formed between the contact points B11, B12, B22, B21 have electromagnetic coupling with the flow spaces formed between the contact points A11, A12, A22, A21, the crosstalk interferences are generated accordingly.

When the connector is used for low-speed signal transmission, the crosstalk interferences between signal terminals are not serious, and may be ignored if considering performance. However, if the connector is used for high-speed signal transmission, the crosstalk interferences between signal terminals causes serious effects.

SUMMARY

Accordingly, an embodiment of the disclosure introduces an electrical connector for reducing high frequency crosstalk interferences, which is provided to insert with at least two mating elements. The electrical connector includes a first joint, a first signal terminal, a second joint, a second signal terminal and a ground terminal. The first joint is used to be inserted by one of the mating elements. The first signal terminal is electrically connected with the mating element inserted within the first joint. The second joint is used to be inserted by another mating element. The second signal terminal is electrically connected with the mating element inserted within the second joint. The ground terminal is electrically connected with the first joint and the second joint, and disposed between the first signal terminal and the second signal terminal. Signal flow spaces located between the ground terminal and respectively the first signal terminal and second signal terminals are used as signal flow paths for the first signal terminal and second signal terminal respectively.

In another embodiment, an electrical connector for reducing high frequency crosstalk interferences, electrical connector for reducing high frequency crosstalk interferences, which is provided to insert with at least two mating elements. The electrical connector includes a first joint, a first signal terminal, a first ground terminal, a second joint, a second signal terminal and a second ground terminal. The first joint is adapted to be inserted by one of the mating elements. The first signal terminal is electrically connected with the mating element inserted within the first joint. The first ground terminal is electrically connected with the first joint and disposed adjacent to the first signal terminal. The second joint is adapted for inserting another one of the mating elements; the second joint and the first joint have a central axis. The second signal terminal is electrically connected with the mating element inserted within the second joint, and the second ground terminal is electrically connected with the second joint and disposed adjacent to the second signal terminal. The first signal terminal and the adjacent first ground terminal, and the second signal terminal and the adjacent second ground terminal are respectively aligned at two sides of the central axis. A first signal flow space formed between the first ground terminal and the first signal terminal is used as a signal flow path for the first signal terminal; a second signal flow space formed between the second ground terminal and the second signal terminal is used as another signal flow path for the second signal terminal.

In an embodiment, RCA connector is preferably used as an explanatory example of an electrical connector for reducing high frequency crosstalk interferences, and used for inserting with AV terminals (so-called Composite video connector).

The advantage for the electrical connector according to the embodiments of the disclosure is to dispose a ground terminal between different signal terminals. The ground terminal may be integrally formed and connected with each of the signal joints; or multiple ground terminals may be respectively connected with their corresponding signal joints. The signal flow spaces formed between the ground terminals with each of the signal terminals may be used as signal flow paths for the first signal terminal and the second signal terminal. Here each of the signal flow spaces is independent to each other, so as to reduce the crosstalk interferences between the adjacent signal terminals during high-speed signal transmission.

BRIEF DESCRIPTION OF THE DRAWINGS

The disclosure will become more fully understood from the detailed description given herein below for illustration only, and thus not limitative of the present invention, wherein:

FIG. 8 is a data diagram of the crosstalk test according the first embodiment;

DETAILED DESCRIPTION

Figure 1:
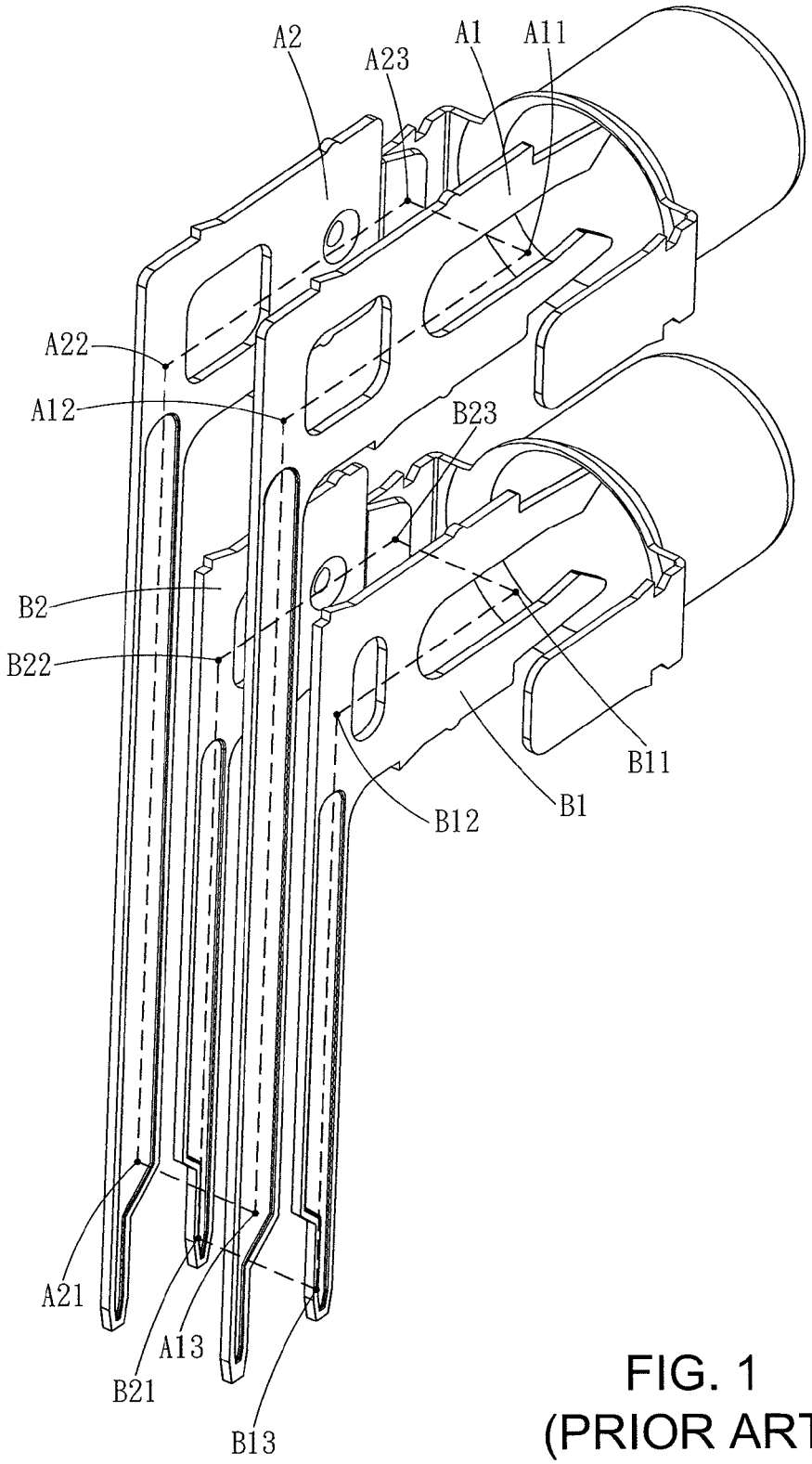
FIG. 1 (PRIOR ART)
FIG. 1 is a partial perspective view for signal connectors on a conventional connector with the structure and positions of ground terminals.
Figure 2:
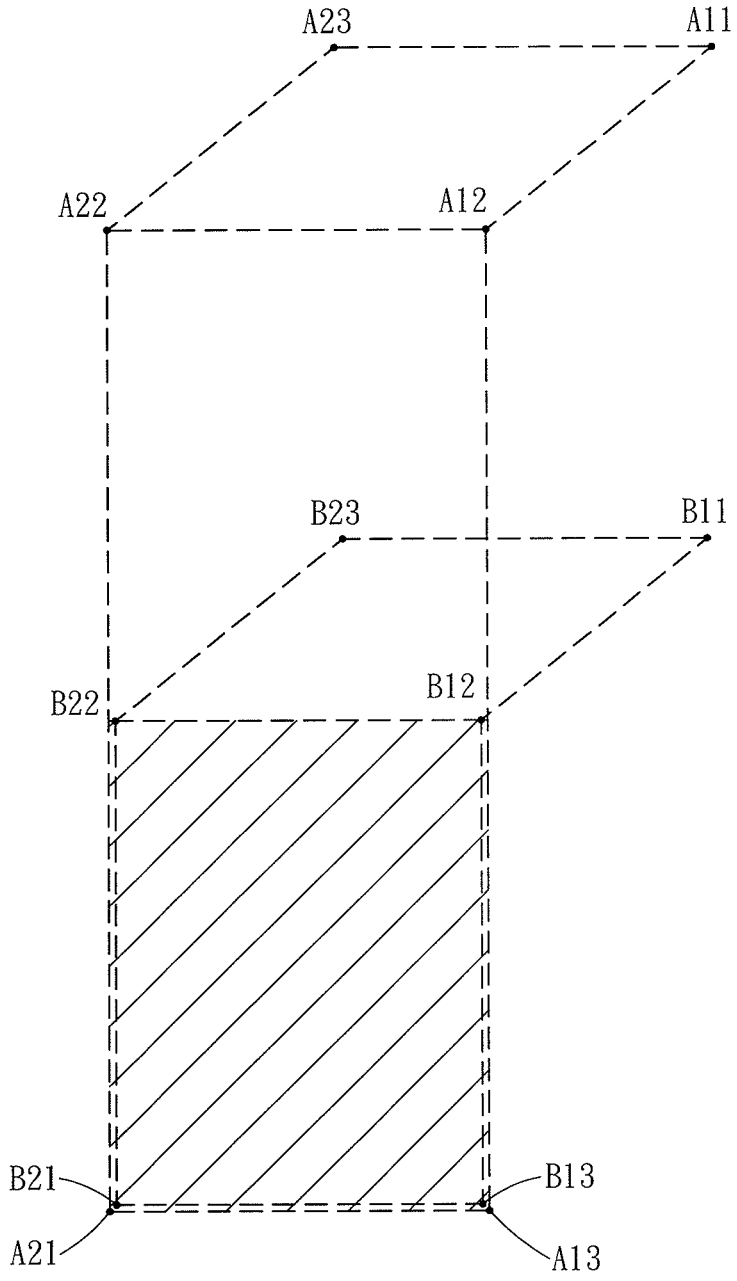
FIG. 2 (PRIOR ART)
FIG. 2 is an explanatory diagram of crosstalk areas for the conventional connector.
Figure 3:
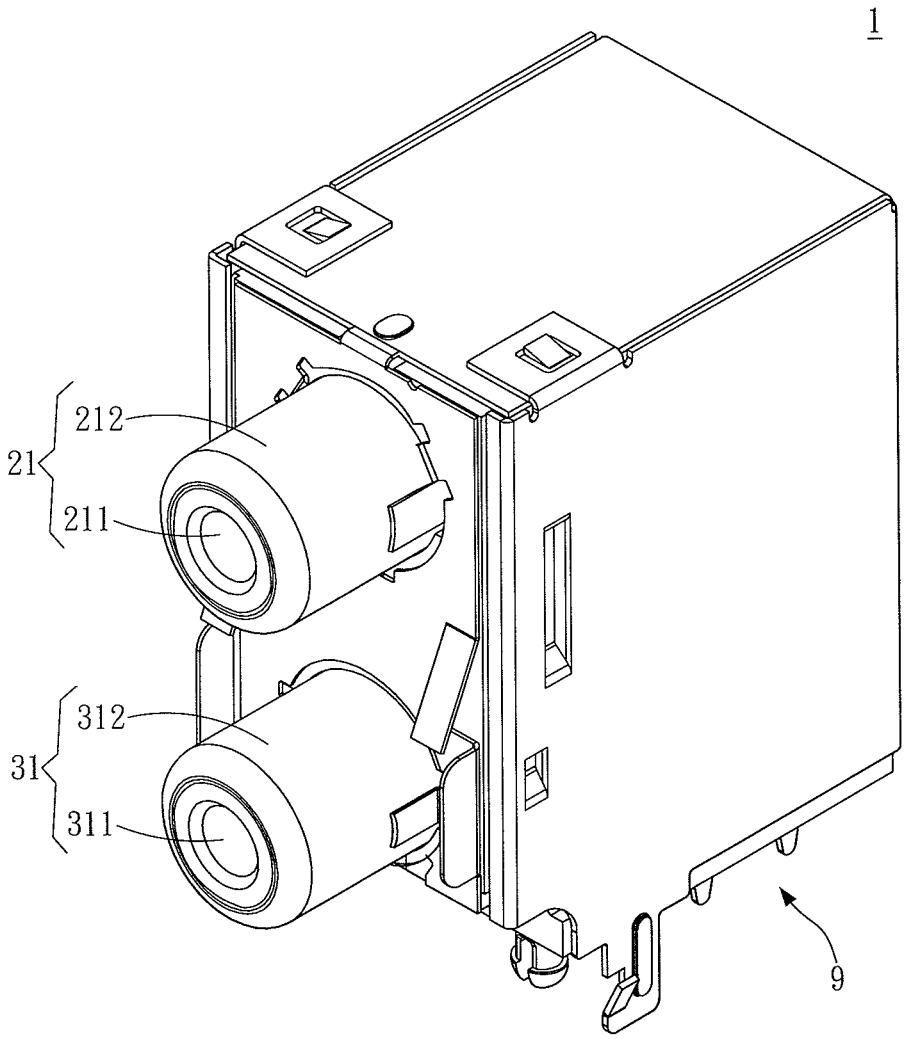
FIG. 3 is a perspective view of an electrical connector according a first embodiment.
Figure 4:
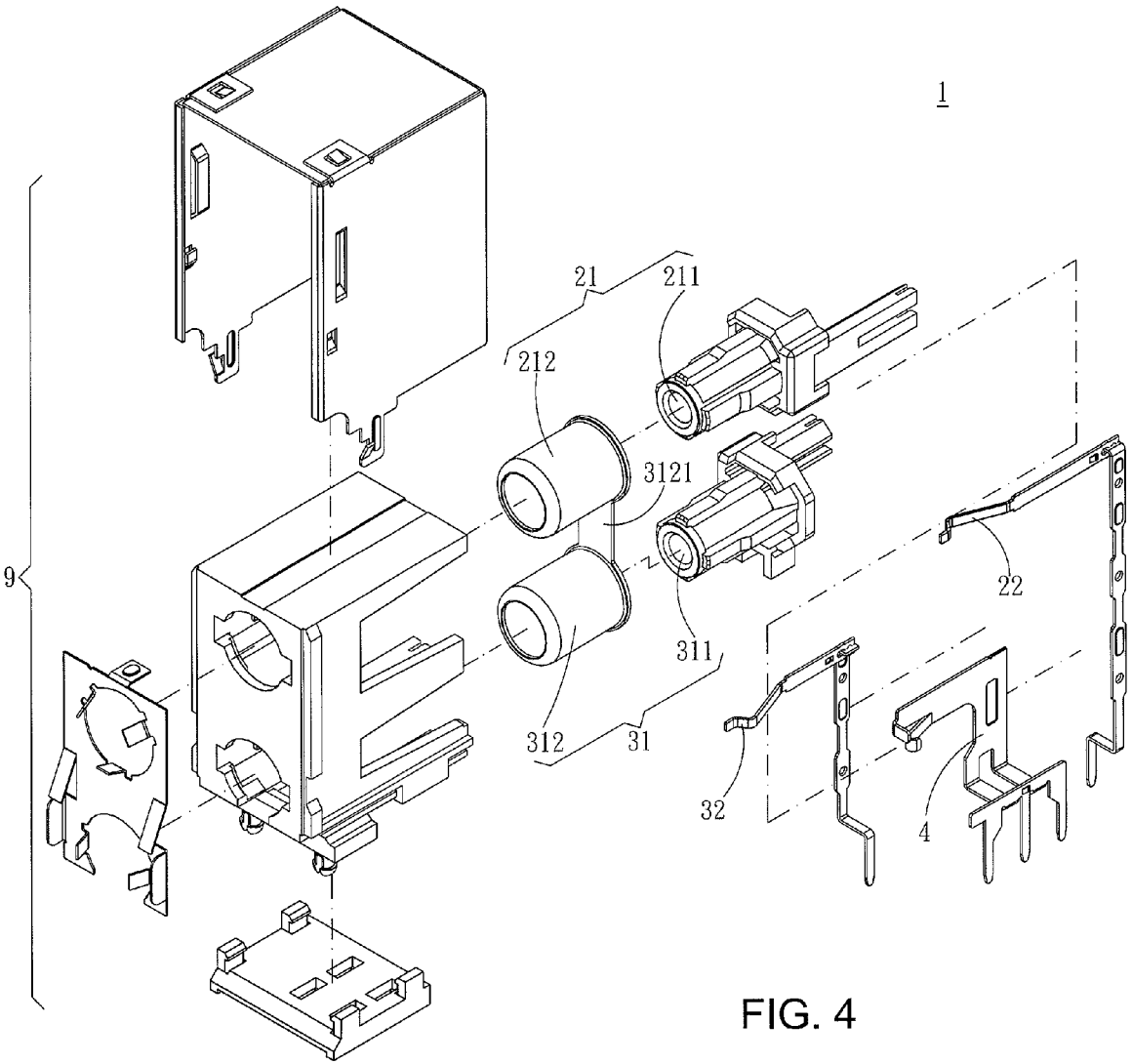
FIG. 4 is an explosion view of the electrical connector according the first embodiment.
Figure 5:
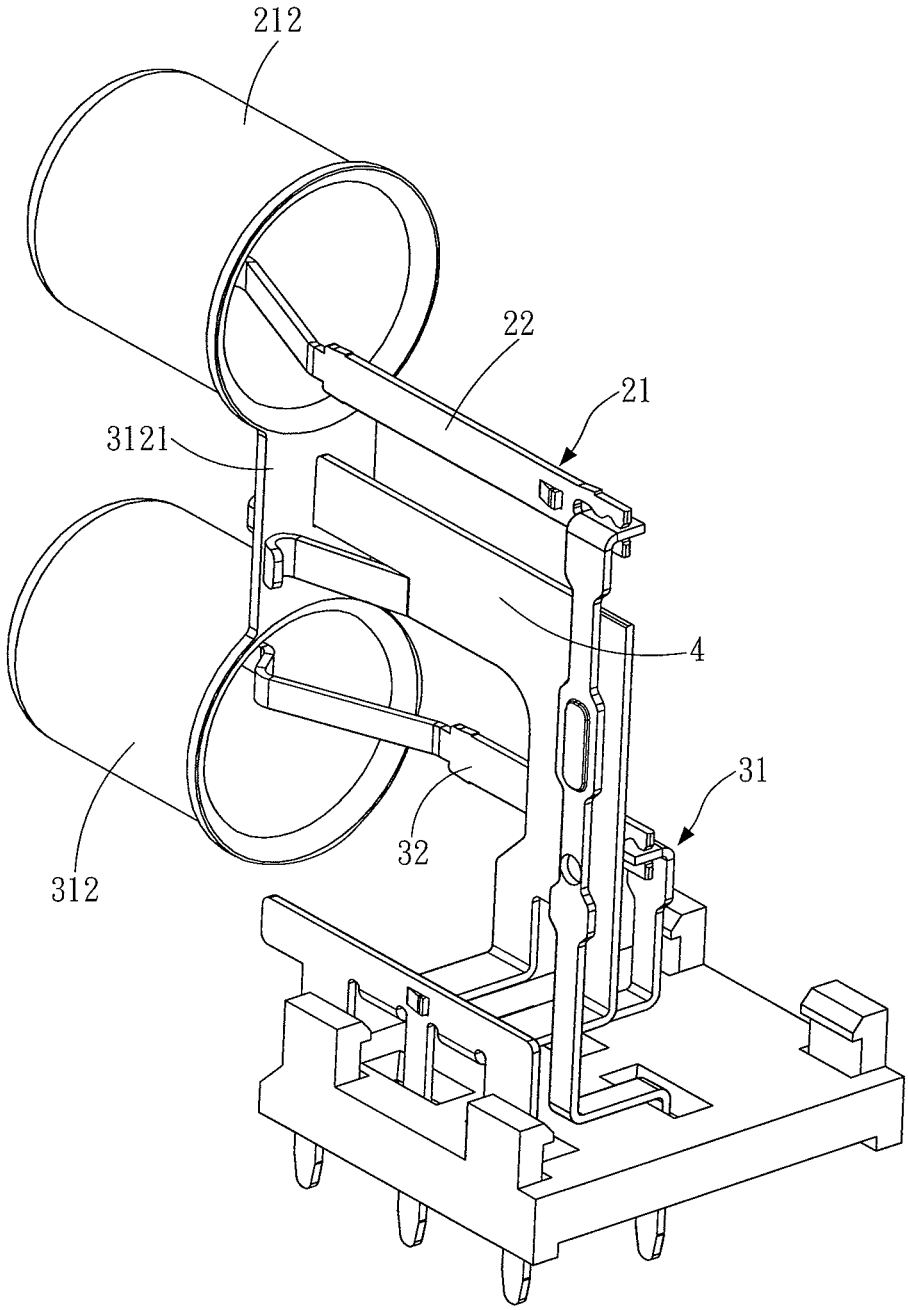
FIG. 5 is a partial explosion view I of the electrical connector according the first embodiment.
Figure 6:
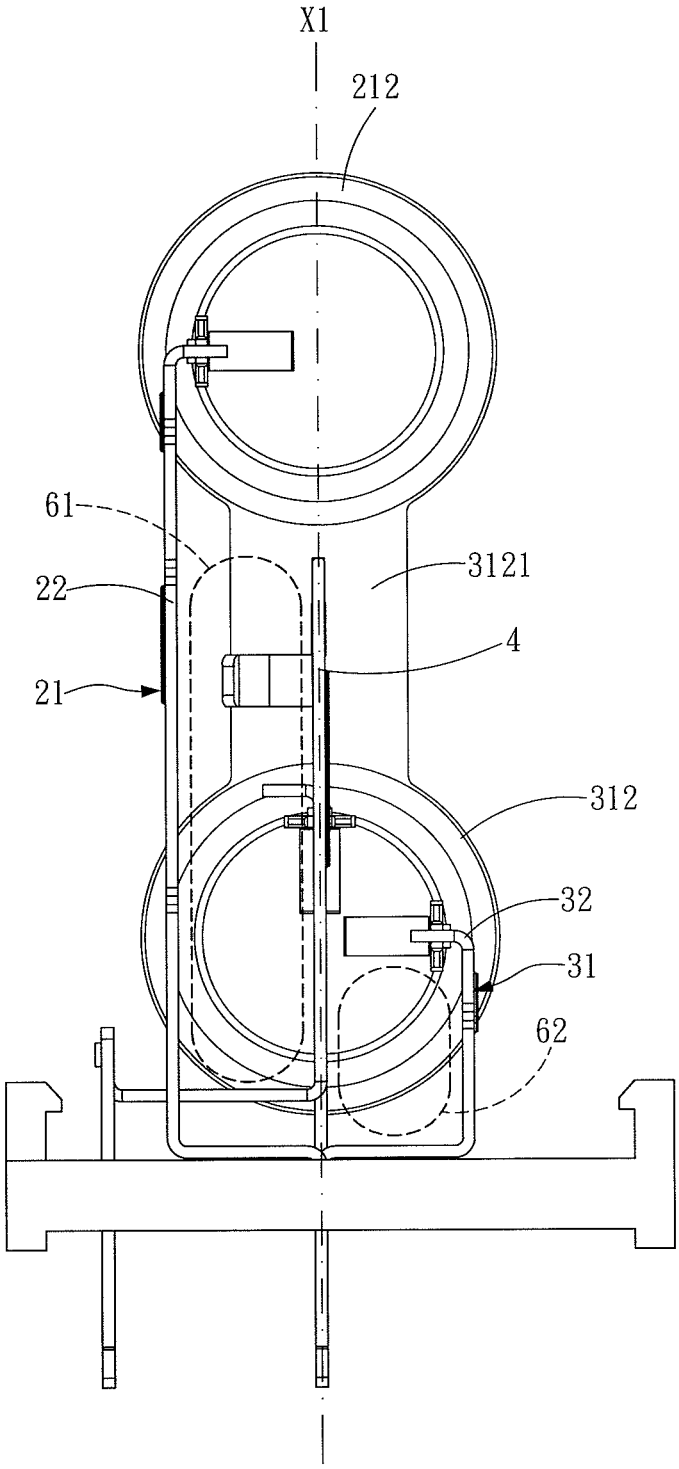
FIG. 6 is a partial explosion view II of the electrical connector according the first embodiment.
Figure 7:
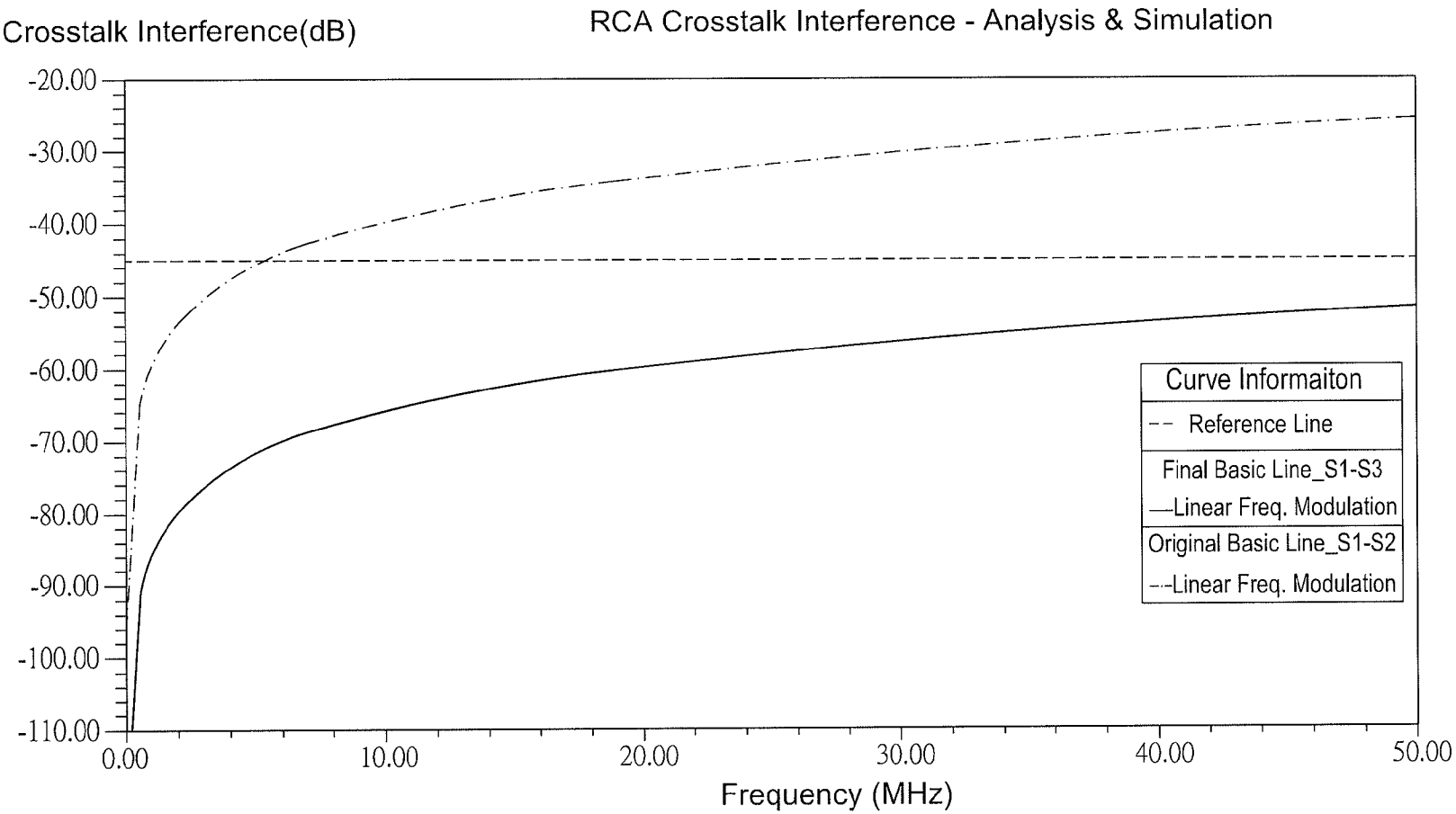
FIG. 7 is a curve diagram of a crosstalk test according the first embodiment.

Please refer to FIGS. 3, 4, 5, 6, 7 and 8 for an electrical connector according to a first embodiment of the disclosure. FIG. 3 is a perspective view of the electrical connector; FIG. 4 is an explosion view of the electrical connector; FIG. 5 is a partial explosion view I of the electrical connector; FIG. 6 is a partial explosion view II of the electrical connector; FIG. 7 is a curve diagram of a crosstalk test; and FIG. 8 is a data diagram of the crosstalk test. In the embodiment, RCA connector is used as an explanatory example of the electrical connector 1 for reducing high frequency crosstalk interferences, and used for inserting with AV terminals (so-called Composite video connector), to transmit video and audio signals; the disclosure is also applicable to any other appropriate connectors. Additionally, although the embodiment takes vertical type connector structures as examples, the vertical type connector structures should not be considered a general limitation to the applications of the disclosure. According to the first embodiment, the electrical connector 1 for reducing high frequency crosstalk interferences includes a first joint 21, a first signal terminal 22, a second joint 31, a second signal terminal 32, and a ground terminal 4.

The first joint 21 mainly includes a first receptacle 211 and a first ground housing 212. The first receptacle 211 is an integrally formed hollow cylinder; the first ground housing 212 is a metal cylinder covering the first receptacle 211.

An end of the first signal terminal 22 is embedded in the first receptacle 211, and is bended and raised on an inner wall of the first receptacle 211, so as to electrically connect with a terminal of the mating element inserted within the first receptacle 211 (not shown). The other end of the first signal terminal 22 is connected onto a printed circuit board (not shown). The structure of the first signal terminal 22 connecting on the printed circuit board depends on the circuit layout of the printed circuit board; no specific structure is defined as a general limitation.

The second joint 31 is located under the first joint 21, mainly including a second receptacle 311 and a second ground housing 312. The second receptacle 311 is an integrally formed hollow cylinder; the second ground housing 312 is a metal cylinder covering the second receptacle 311. In the embodiment, parts of the second ground housing 312 and the first ground housing 212 are possible to connect and electrically conduct with each other; for example, the second ground housing 312 is connected with the first ground housing 212 through a connecting piece 3121.

An end of the second signal terminal 32 is embedded in the second receptacle 311, and is bended and raised on an inner wall of the second receptacle 311, so as to electrically connect with a terminal of the mating element inserted within the second receptacle 311 (not shown). The other end of the second signal terminal 32 is connected onto a printed circuit board (not shown). The structure of the second signal terminal 32 connecting on the printed circuit board depends on the circuit layout of the printed circuit board; no specific structure is defined as a general limitation.

In the embodiment, an explanatory example is given with the end of the first signal terminal 22 embedded in the first receptacle 211 and the end of the second signal terminal 32 embedded in the second receptacle 311; yet such example should not be considered as a general limitation to the disclosure. The end of first signal terminal 22 may be alternatively disposed at the terminal portion of the first receptacle 211, and the end of the second signal terminal 32 may be alternatively disposed at the terminal portion of the second receptacle 311. When the mating element inserts into the first receptacle 211 or the second receptacle 311, if the terminal of the mating element is long enough, the mating element is able to pass through the first receptacle 211 or the second receptacle 311 and thereby electrically connecting with the first signal terminal 22 or the second signal terminal 32 at the terminal portion of the first receptacle 211 or the second receptacle 311.

The ground terminal 4 is electrically connected with the first ground housing 212 of the first joint 21 and the second ground housing 312 of the second joint 31; meanwhile, the ground terminal 4 is located between the first signal terminal 22 and the second signal terminal 32. Here, an end of the ground terminal 4 is able to alternatively connect with the connecting piece 3121. For example, in the embodiment, the ground terminal 4, the connecting piece 3121, the first ground housing 212 and the second ground housing 312 are integrally formed as a whole, such that the ground terminal 4 is electrically connected with the first ground housing 212 and the second ground housing 312, and also the other end of the ground terminal 4 is connected with the mating element. The structures for the ground terminal 4 and the connecting piece 3121 mentioned above are for explanation purposes only, and should not be considered as general limitations to the disclosure.

Since the ground terminal 4 is located between the first signal terminal 22 and the second signal terminal 32, two signal flow spaces are formed between the ground terminal 4 and respectively the first signal terminal 22 and the second signal terminal 32. In other words, the first signal flow space 61 formed between the ground terminal 4 and the first signal terminal 22 is able to be used as a signal flow path for the first signal terminal 22; the second signal flow space 62 formed between the ground terminal 4 and the second signal terminal 32 is able to be used as a signal flow path for the second signal terminal 32. Since the first signal flow space 61 and the second signal flow space 62 are not electromagnetically coupled with each other, the crosstalk interferences between the first signal terminal 22 and the second signal terminal 32 are able to be reduced. As shown in FIG. 6, in view of the crosstalk requirements for general connectors, the crosstalk interference is required to be lower than −45 dB under a transmission frequency 50 MHz. The embodiment is able to have a crosstalk interference lower than −50 dB at transmission frequency 50 MHz.

What emphasized in the disclosure is that every signal terminal (first signal terminal 22, second signal terminal 32), is a single terminal structure. Additionally, each signal terminal transmits a group of signals; the embodiment does not use multiple terminals to transmit the same group of signals. Furthermore, the electrical connector of the disclosure further includes a case body 9 for installing the first joint 21 and the second joint 31 therein. The case body 9 may selectively include elements such as an isolation base, a shielding shall etc., but here the case body 9 is not limited to any specific elements.

Figure 9:
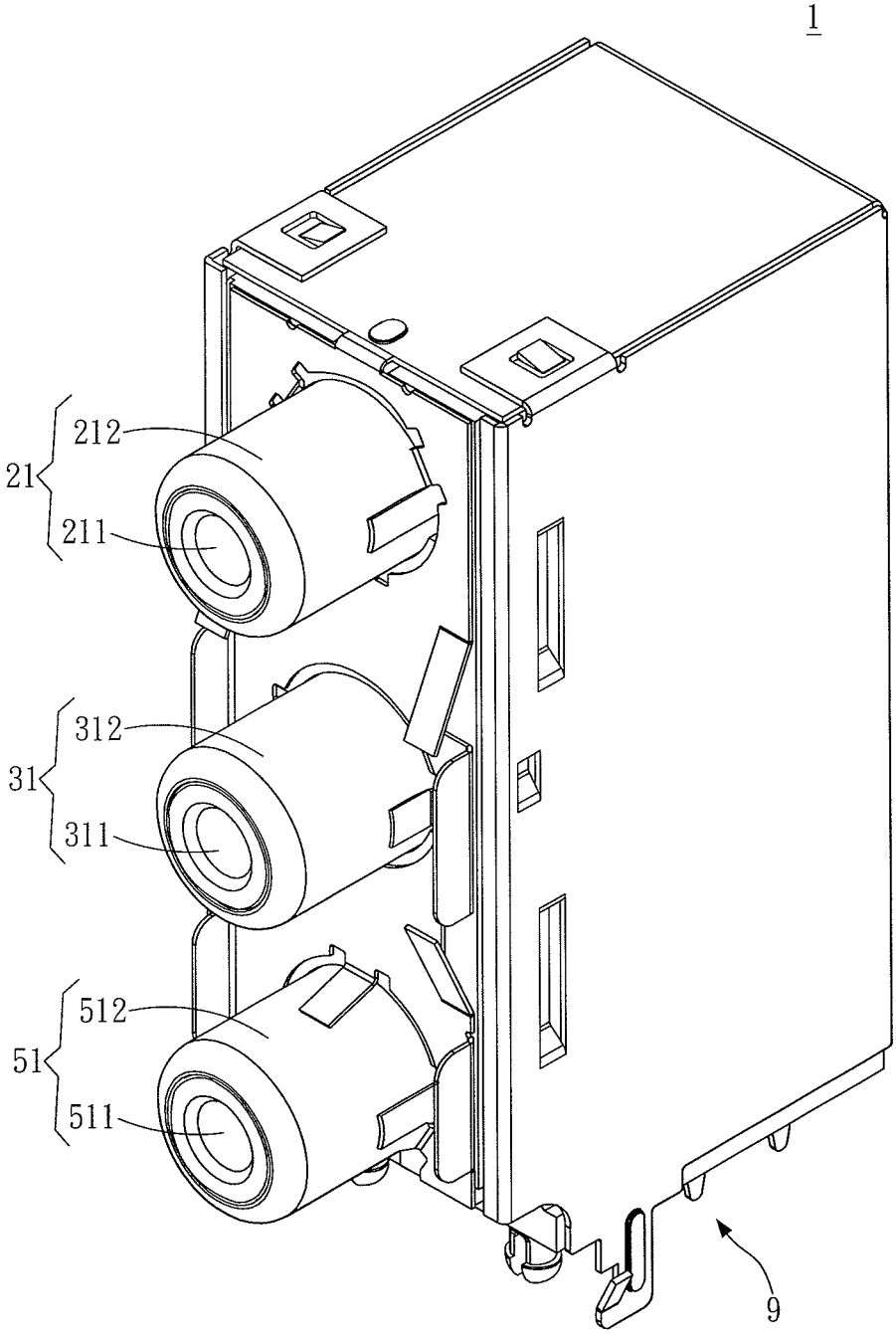
FIG. 9 is a perspective view of an electrical connector according a second embodiment.
Figure 10:
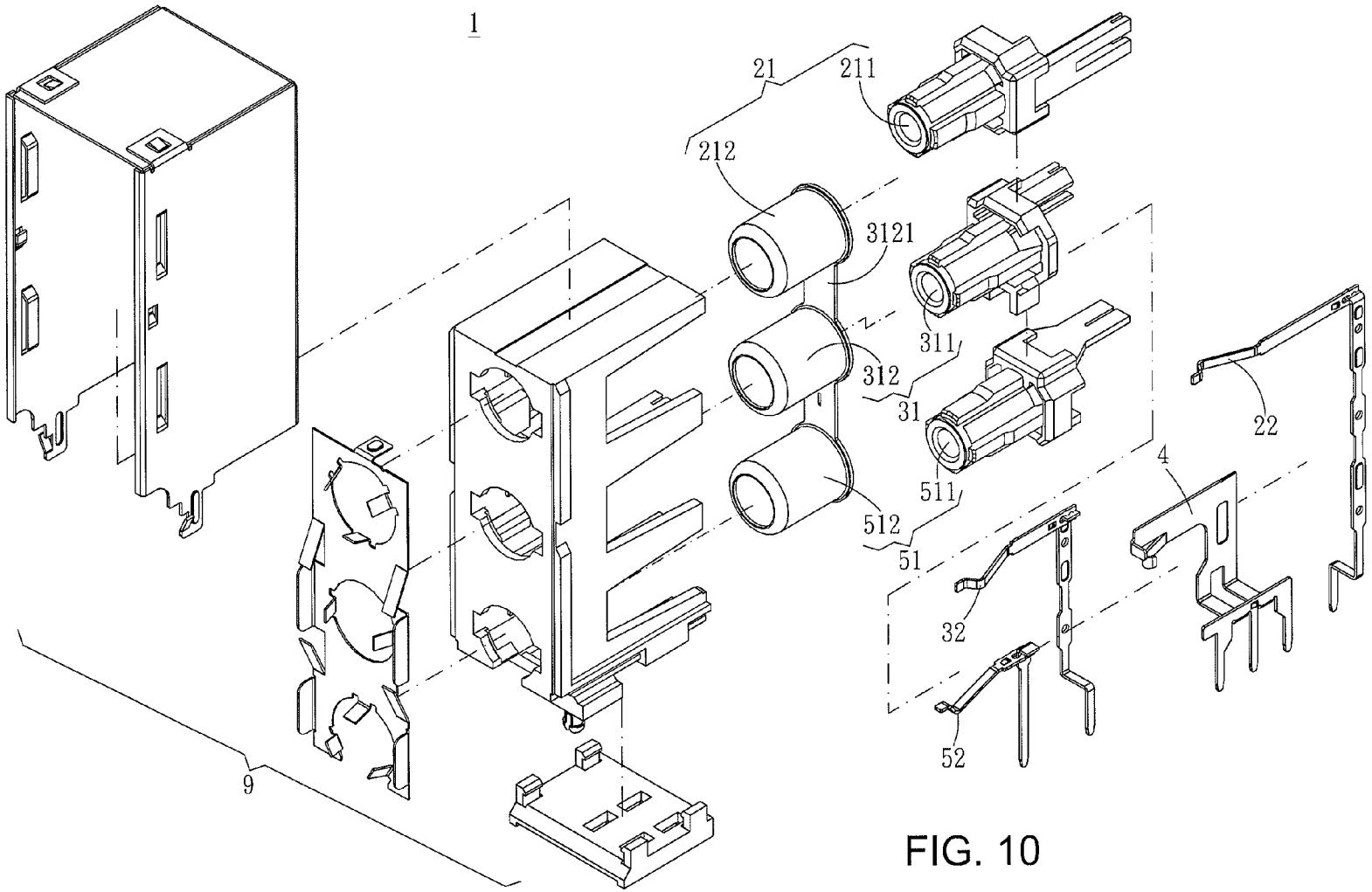
FIG. 10 is an explosion view of the electrical connector according the second embodiment.
Figure 11:
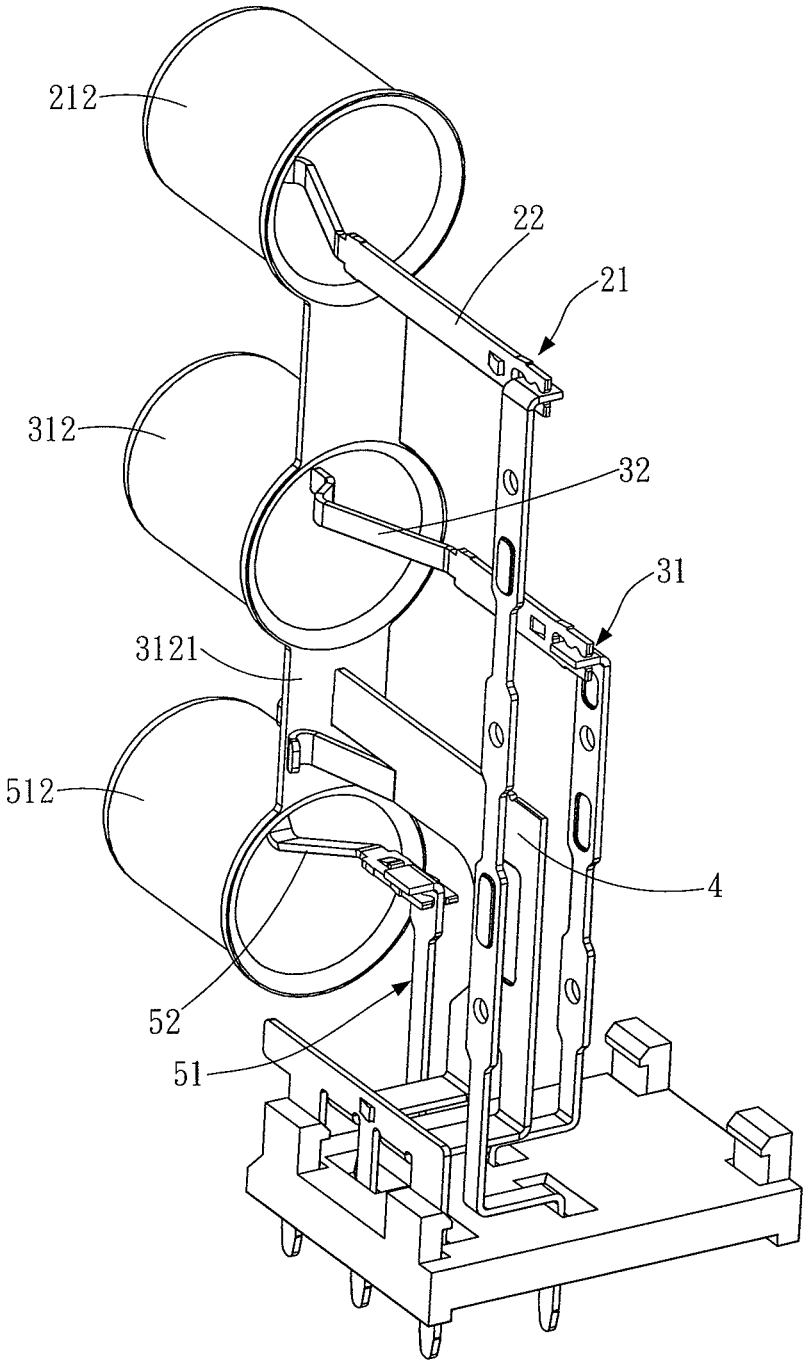
FIG. 11 is a partial perspective view I of the electrical connector according the second embodiment.
Figure 12:
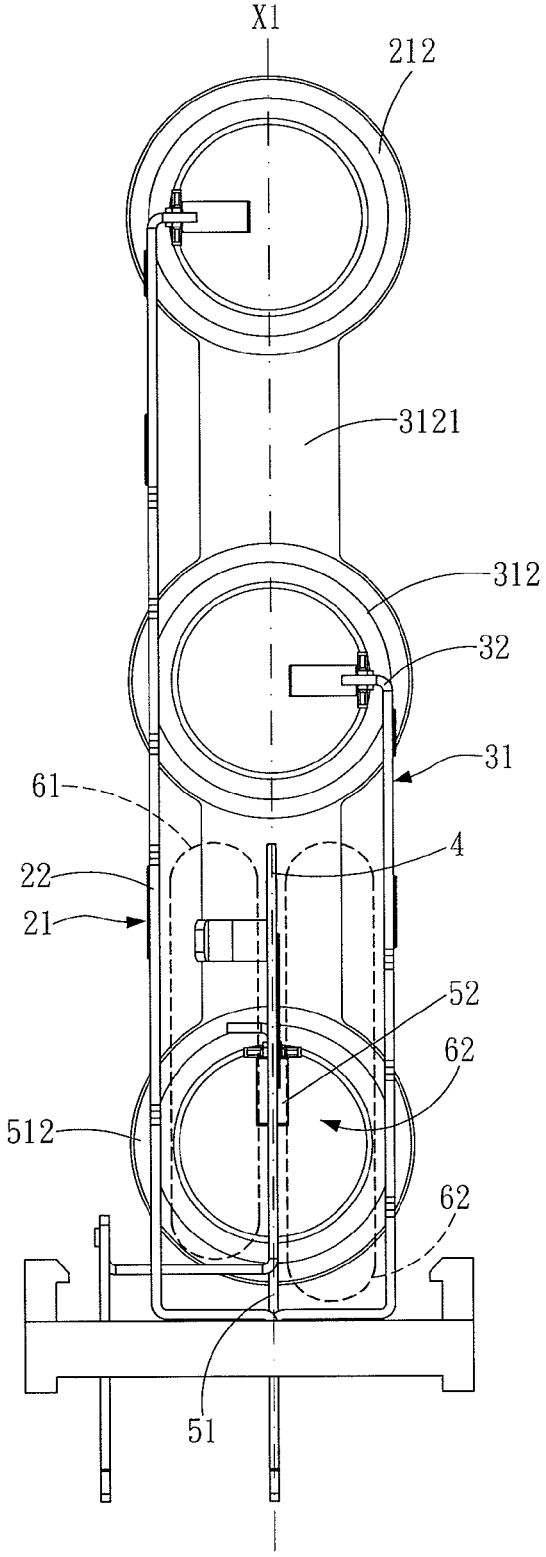
FIG. 12 is a partial perspective view II of the electrical connector according the second embodiment.
Figure 13:
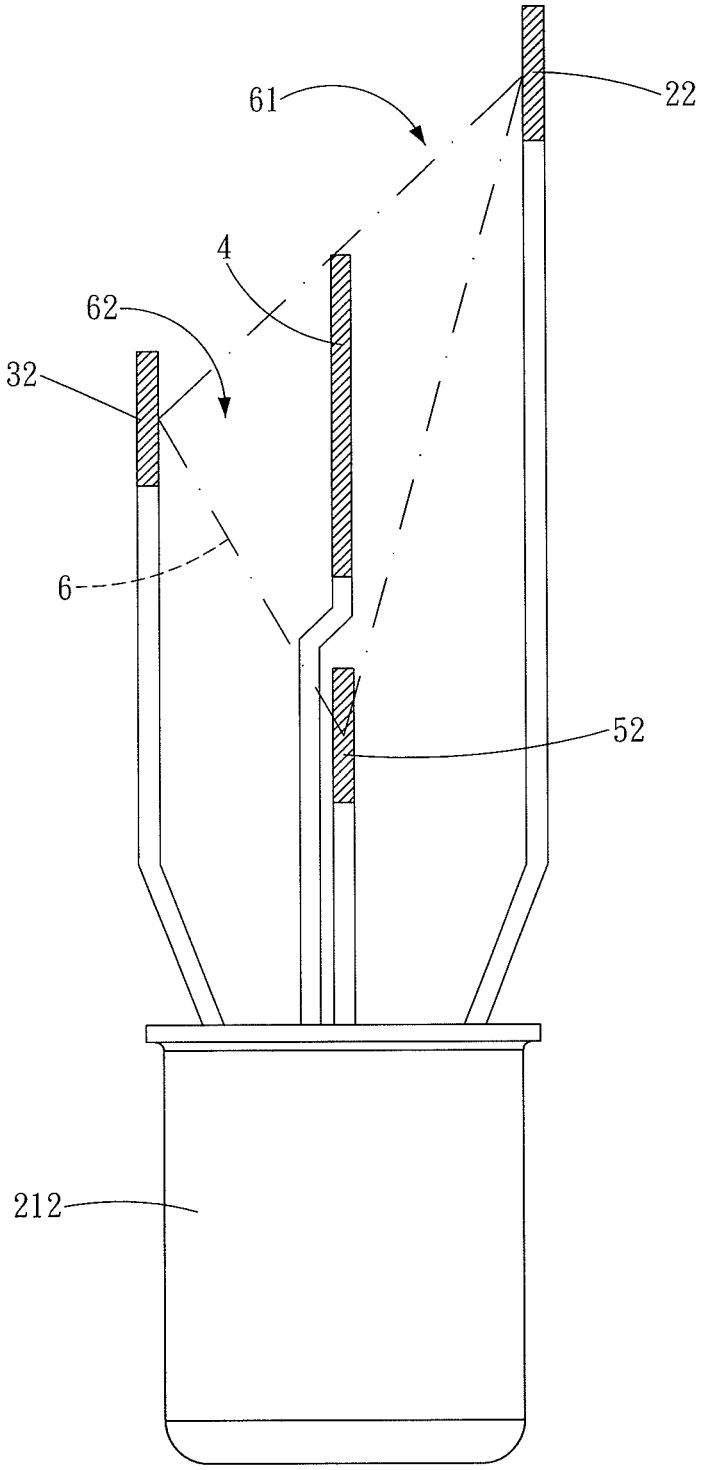
FIG. 13 is a top partial perspective view of the electrical connector according the second embodiment.

Please refer to FIGS. 9, 10, 11, 12 and 13 for an electrical connector according to a second embodiment of the disclosure. FIG. 9 is a perspective view of an electrical connector according the second embodiment; FIG. 10 is an explosion view of the electrical connector; FIG. 11 is a partial perspective view I of the electrical connector; FIG. 12 is a partial perspective view II of the electrical connector; FIG. 13 is a top partial perspective view of the electrical connector. The differences between the present embodiment and the first embodiment are the amount and structures of the joints and signal terminals. In the present embodiment, the electrical connector 1 further includes a third joint 51 and a third signal terminal 52. The third joint 51 is located under the second joint 31, mainly including a third receptacle 511 and a third ground housing 512. The third receptacle 511 is an integrally formed hollow cylinder; the third ground housing 512 is a metal cylinder covering the third receptacle 511. Furthermore, parts of the third ground housing 512 and the second ground housing 312 are possible to connect and electrically conduct with each other. An end of the third signal terminal 52 is embedded in the third receptacle 511, and is bended and raised on an inner wall of the third receptacle 511. The other end of the third signal terminal 52 is connected with the mating element, such that the ground terminal 4 is located between the first signal terminal 22, the second signal terminal 32 and the third signal terminal 52. Here the structure of the end of the third signal terminal 52 connecting with the mating element depends on the circuit layout of the mating element; no specific structure is defined as a general limitation.

Please refer to FIG. 13, which illustrates the position distributions of the terminals according to the second embodiment. In the present embodiment, a triangle area 6 surrounded by the first signal terminal 22, the second signal terminal 32 and the third signal terminal 52. The ground terminal 4 is located in the triangle area 6 such that a signal flow space is formed between the ground terminal 4 and respectively the first signal terminal 22, the second signal terminal 32, and the third signal terminal 52. In other words, the first signal flow space 61 formed between the ground terminal 4 and first signal terminal 22 is used as a signal flow path for the first signal terminal 22. The second signal flow space 62 formed between the ground terminal 4 and the second signal terminal 32 is used as a signal flow path for the second signal terminal 32. The third signal flow space 63 formed between the ground terminal 4 and the third signal terminal 52 is used as a signal flow path for the third signal terminal 52. Therefore, at the three angles of the triangle area 6 surrounded by the first signal terminal 22, the second signal terminal 32, and the third signal terminal 52, the first signal flow space 61, the second signal flow space 62 and the third signal flow space are formed respectively. Since the first signal flow space 61, the second signal flow space 62 and the third signal flow space 63 are independent from each other, the crosstalk interferences between the first signal terminal 22, the second signal terminal 32, and the third signal terminal 52 are further reduced.

Figure 14:
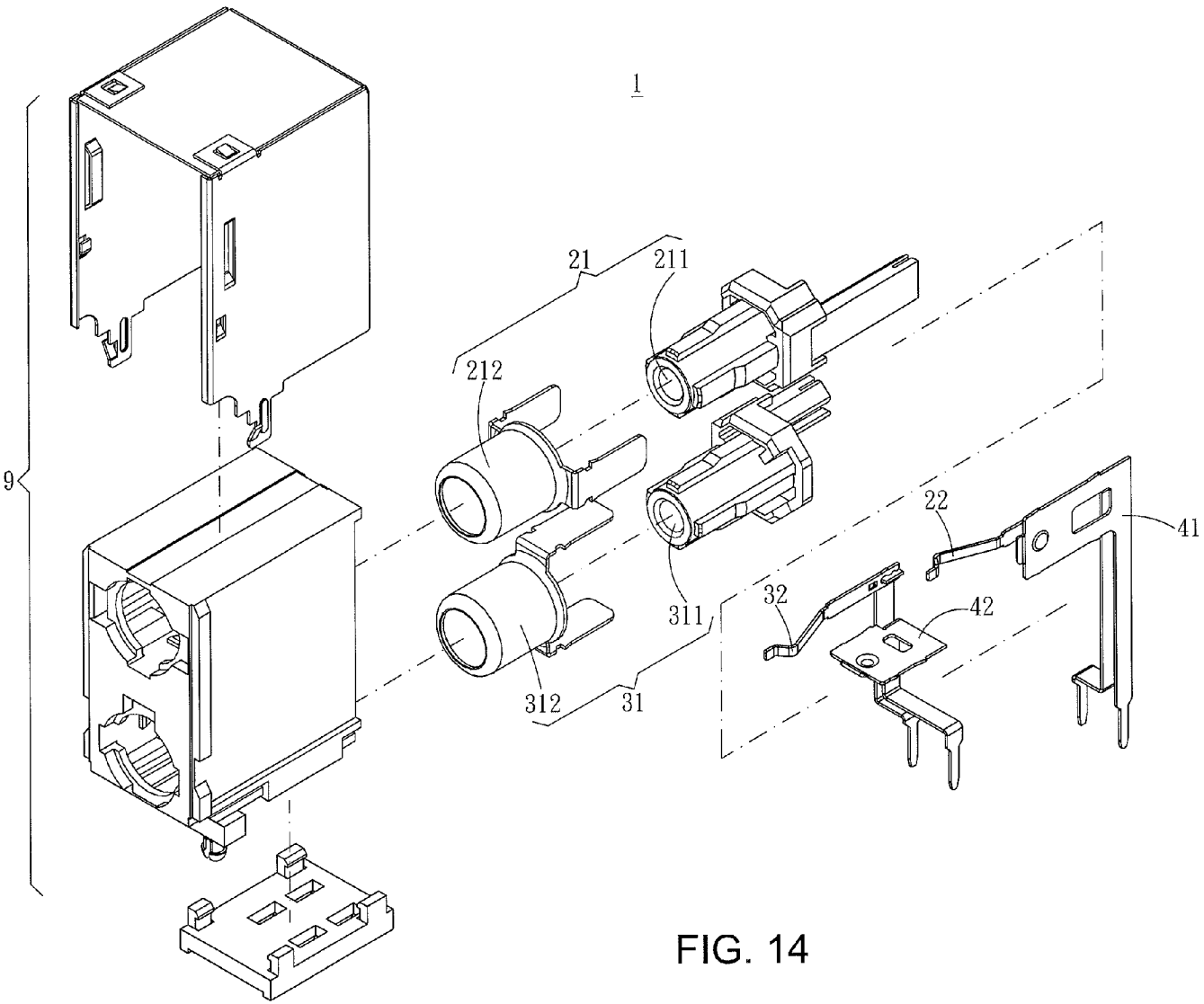
FIG. 14 is an explosion view of an electrical connector according a third embodiment.
Figure 15:
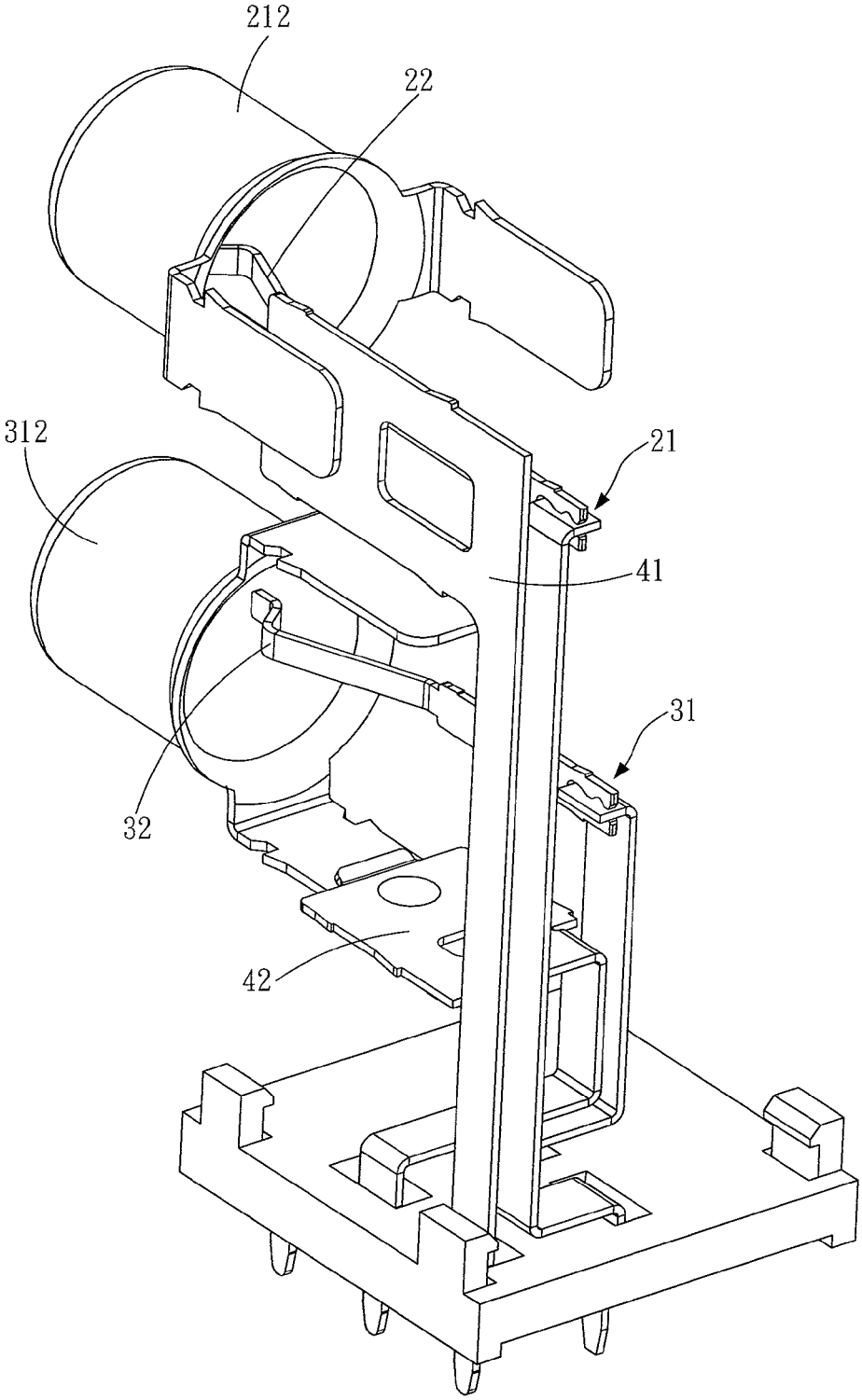
FIG. 15 is a partial perspective view I of the electrical connector according the third embodiment.
Figure 16:
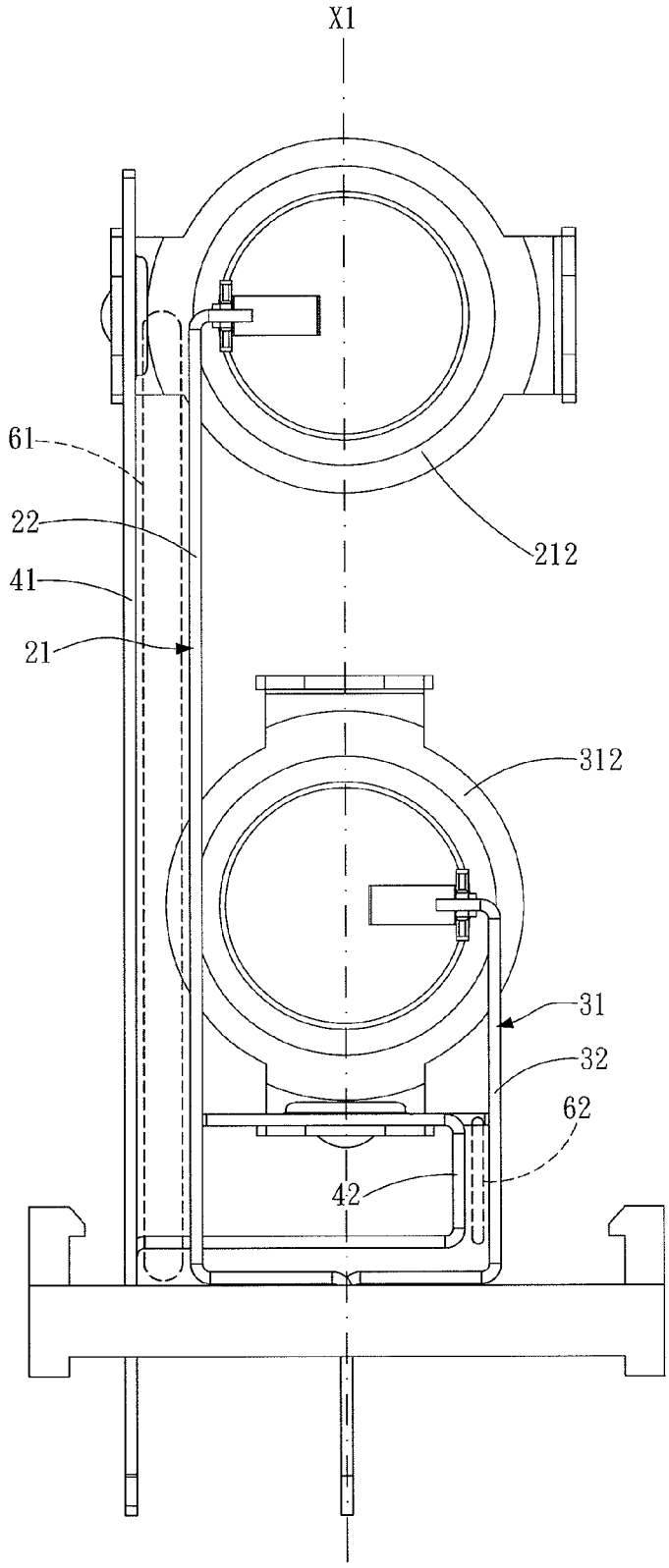
FIG. 16 is a partial perspective view II of the electrical connector according the third embodiment.
Figure 17:
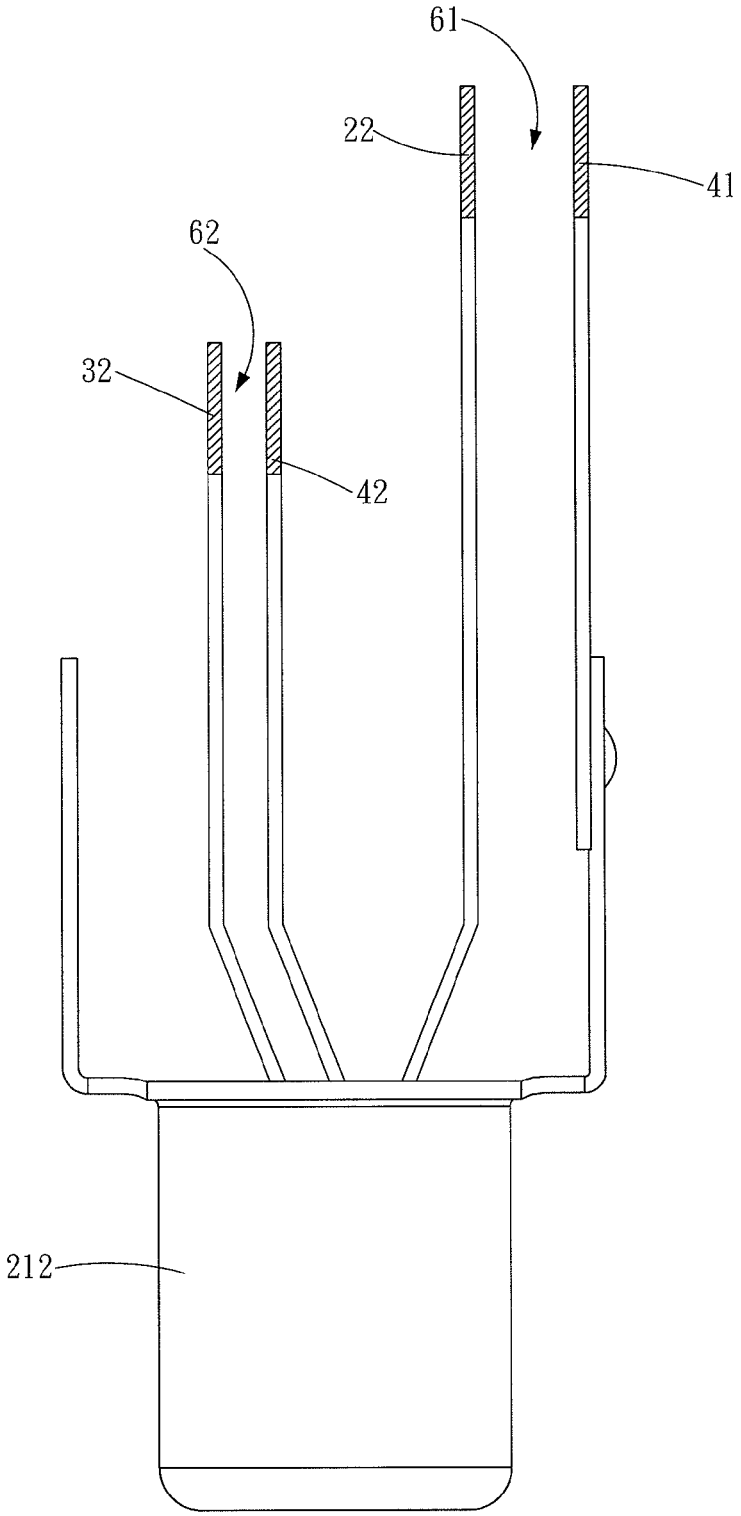
FIG. 17 is a top partial perspective view of the electrical connector according the third embodiment.
Figure 18:
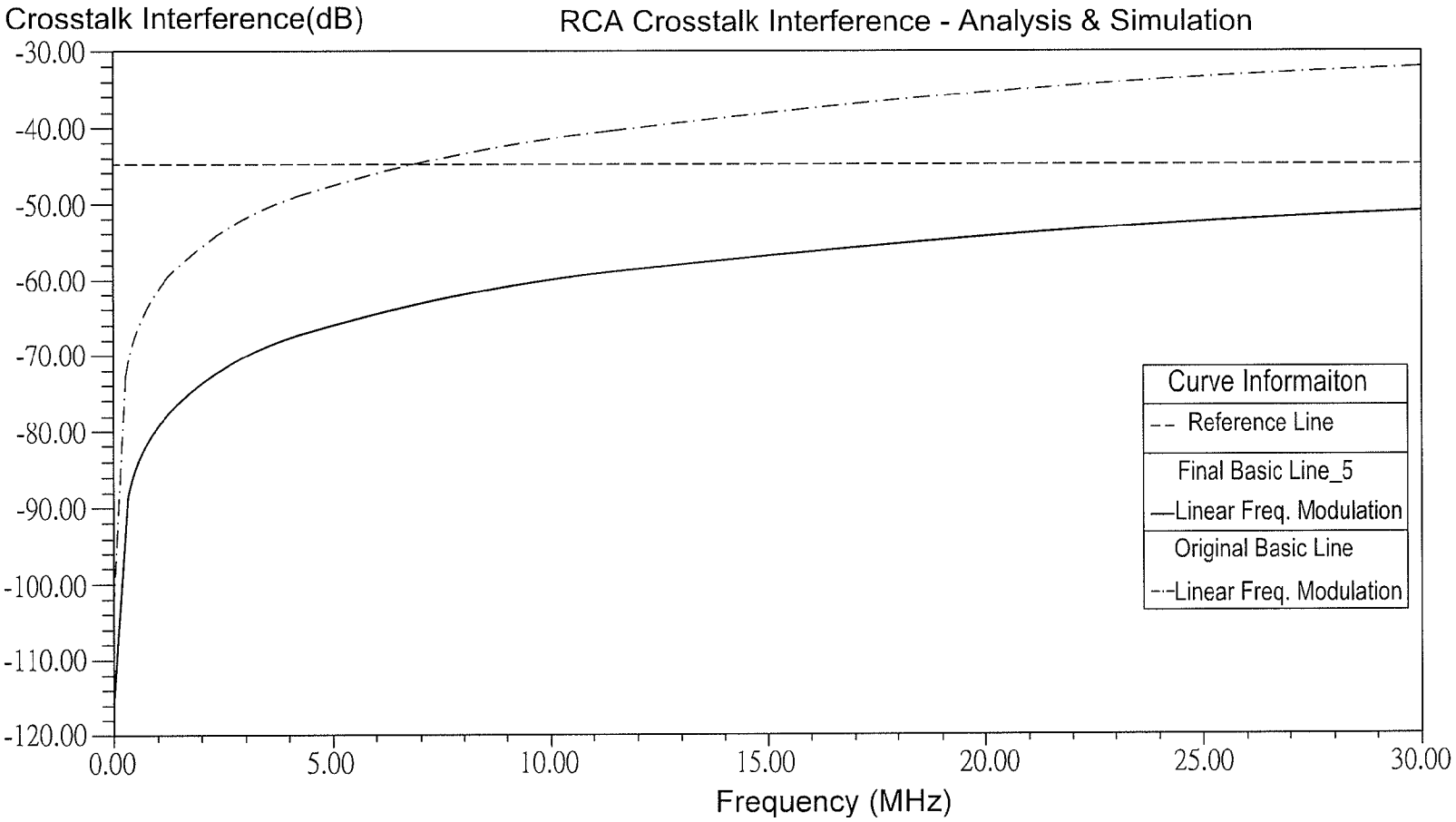
FIG. 18 is a curve diagram of a crosstalk test according the third embodiment.

Please refer to FIGS. 14, 15, 16, 17 and 18 for a third embodiment according to the disclosure. FIG. 14 is an explosion view of the electrical connector; FIG. 15 is a partial perspective view I of the electrical connector; FIG. 16 is a partial perspective view II of the electrical connector; FIG. 17 is a top partial perspective view of the electrical connector; and FIG. 18 is a curve diagram of a crosstalk test. The differences between the present embodiment and the first embodiment are the amount and structures of the joints and signal terminals. In the present embodiment, the electrical connector 1 for reducing high frequency crosstalk interferences further includes a first ground terminal 41 and a second ground terminal 42. The first joint 21 and the second joint 31 extend a central axis X1. The adjacent first signal terminal 22 and first ground terminal 41, and the adjacent second signal terminal 32 and second ground terminal 42 are respectively aligned at the two sides of the central axis X1. The first ground terminal 41 is disposed adjacent to the first signal terminal 22, with at least a part thereof in parallel to the first signal terminal 22; in addition, the first ground terminal 41 is electrically connected with the first ground housing 212 of the first joint 21. The second ground terminal 42 is disposed adjacent to the second signal terminal 32, with at least a part thereof in parallel to the second signal terminal 32; in addition, the second ground terminal 42 is electrically connected with the second ground housing 312 of the second joint 31.

In the present embodiment, in comparison with the position of the first signal terminal 22, the first ground terminal 41 is located at the outer side away from the first receptacle 211. The second ground terminal 42 is located between the first signal terminal 22 and the second signal terminal 32. In other words, the alignment sequence from left to right is: the first ground terminal 41, the first signal terminal 22, the second ground terminal 42, and the second signal terminal 32 (as shown in FIG. 15). Therefore, the first signal flow space 61 formed between the first ground terminal 41 and the first signal terminal 22 is used as the signal flow path for the first signal terminal 22; the second signal flow space 62 formed between the second ground terminal 42 and the second signal terminal 32 is used as the signal flow path for the second signal terminal 32. Since the first signal flow space 61 and the second signal flow space 62 are independent from each other, and also the second ground terminal 42 is located between the first signal flow space 61 and the second signal flow space 62, the crosstalk interferences between the first signal terminal 22 and the second signal terminal 32 are further reduced. As shown in FIG. 18, in view of the crosstalk requirements for general connectors, the crosstalk interference is required to be lower than −45 dB under a transmission frequency 50 MHz.

The embodiment is able to have a crosstalk interference lower than −50 dB at transmission frequency 50 MHz.

In the descriptions mentioned above, the third embodiment disposes the second ground terminal 42 between the first signal terminal 22 and the second signal terminal 32 as an example, which should not be considered as a general limitation to the disclosure. According to the alignments of each signal terminal and each ground terminal, the first ground terminal 41 may be aligned between the first signal terminal 22 and the second signal terminal 32, or alternatively both the first ground terminal 41 and the second ground terminal 42 are aligned between the first signal terminal 22 and the second signal terminal 32.

Figure 19:
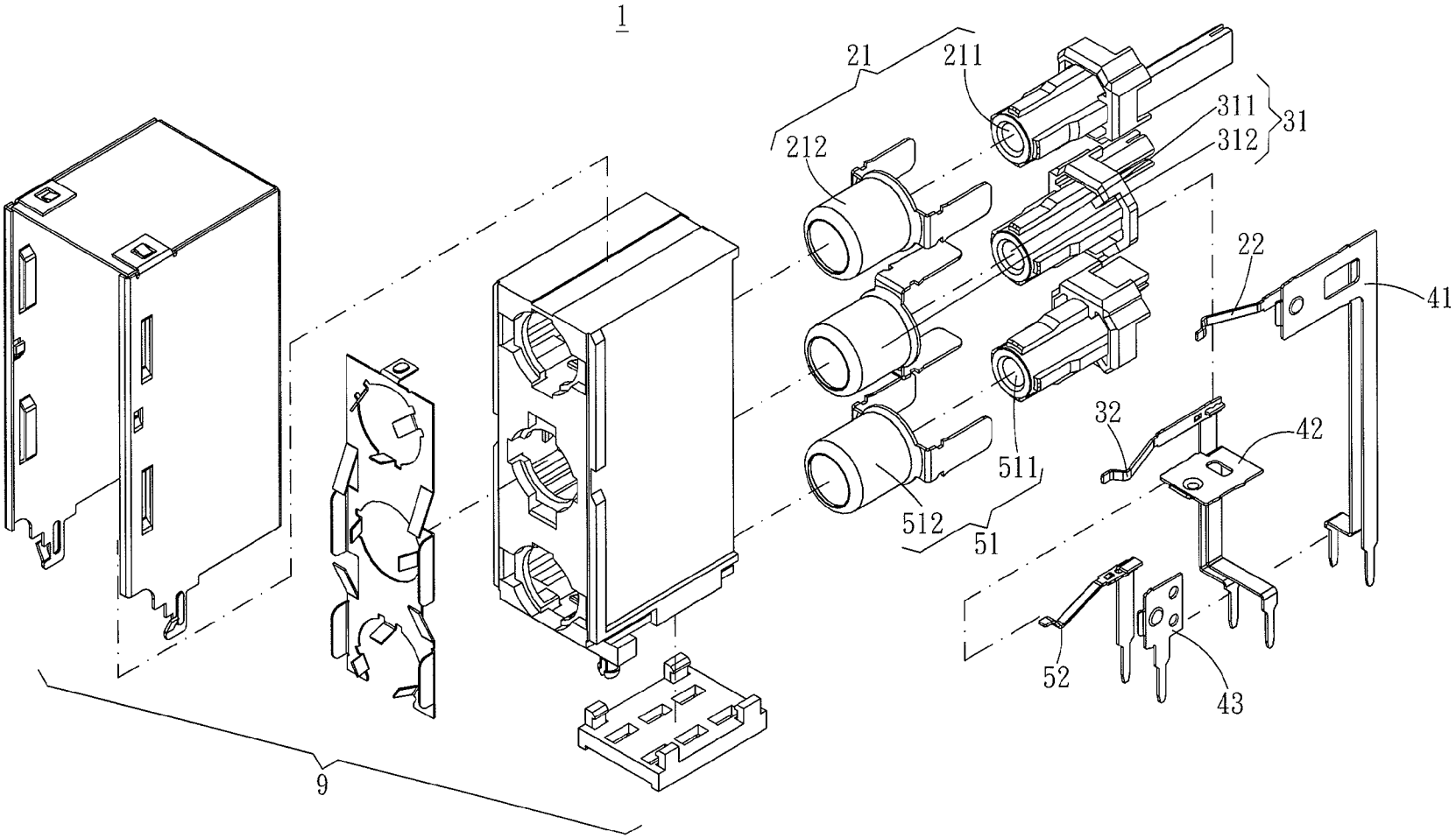
FIG. 19 is an explosion view of an electrical connector according a fourth embodiment.
Figure 20:
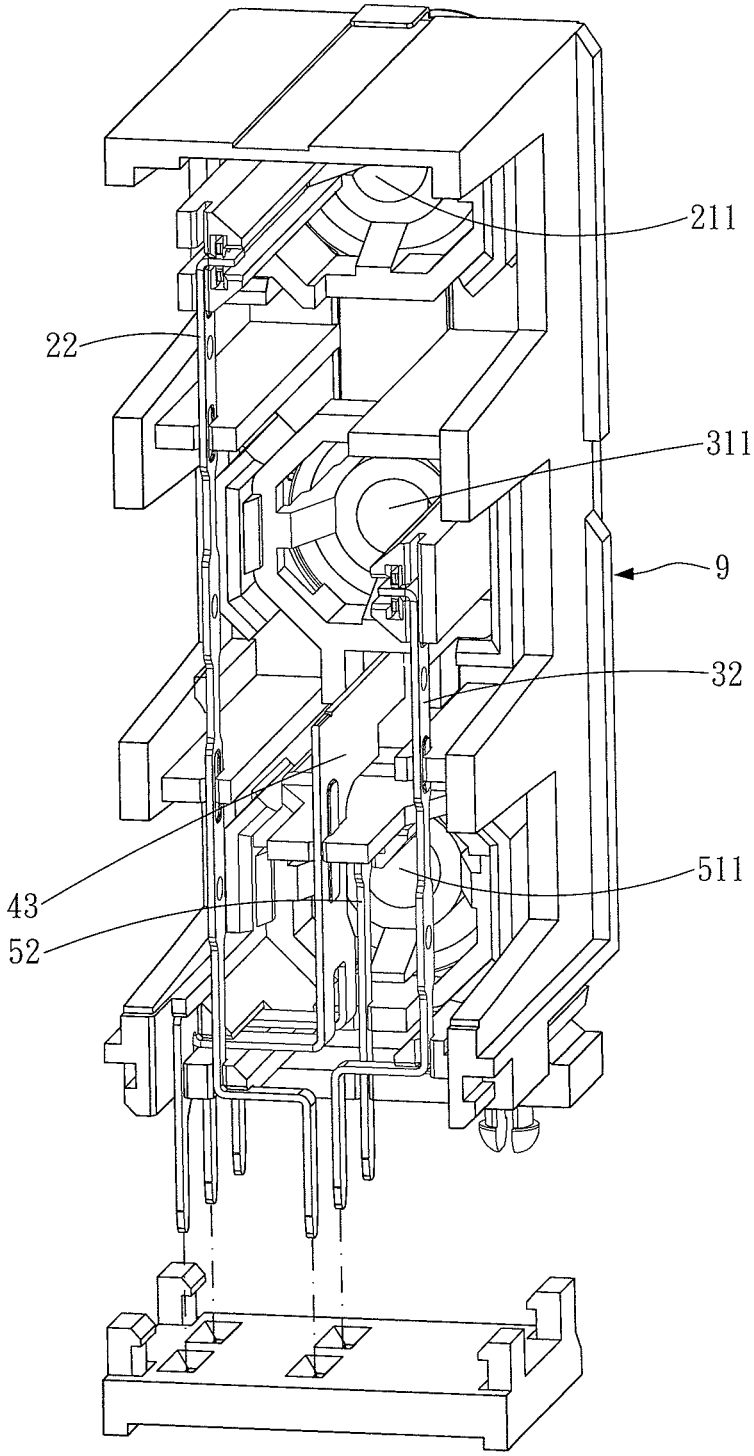
FIG. 20 is a partial perspective view of the electrical connector according the fourth embodiment.
Figure 21:
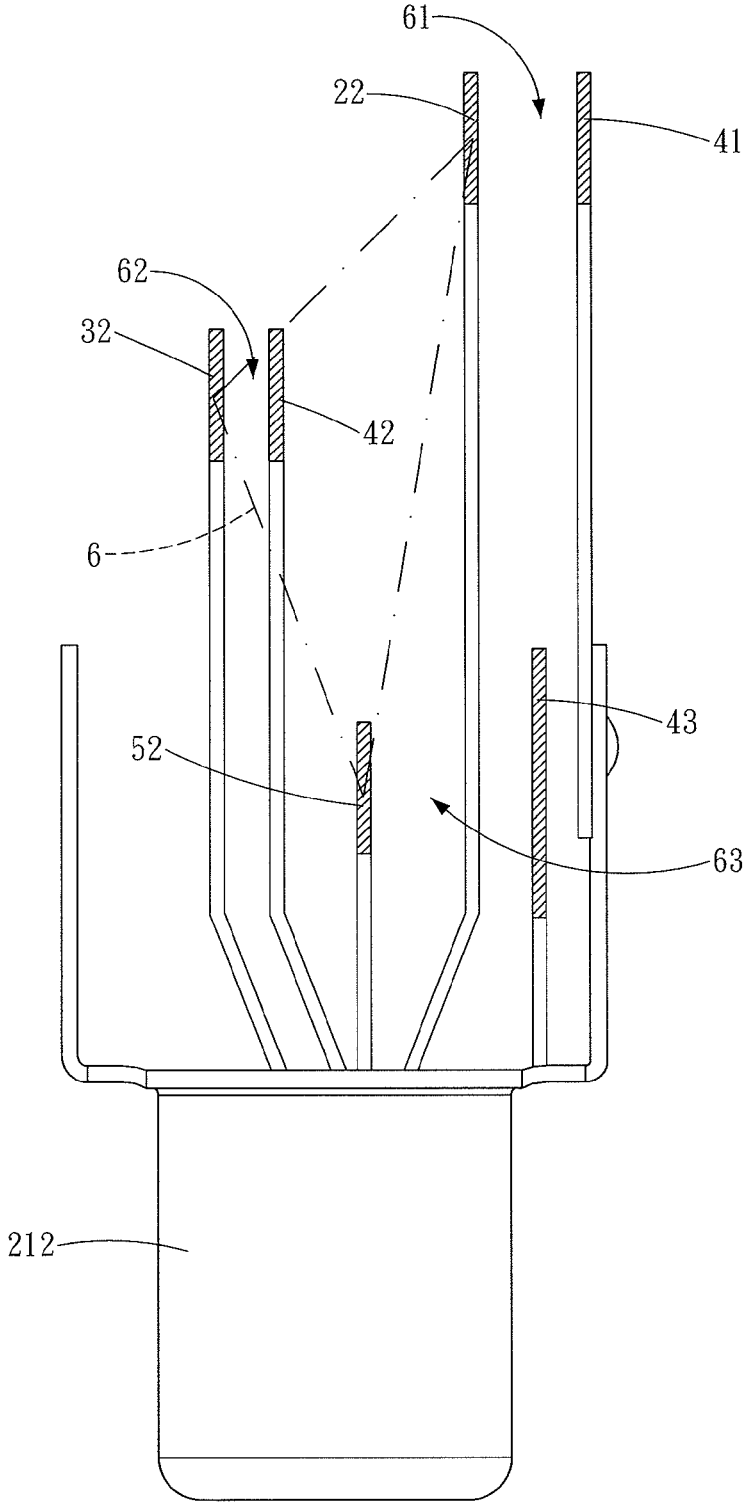
FIG. 21 is a top partial perspective view of the electrical connector according the fourth embodiment.

Please refer to FIGS. 19, 20 and 21 for a fourth embodiment according to the disclosure. FIG. 19 is an explosion view of an electrical connector; FIG. 20 is a partial perspective view of the electrical connector; and FIG. 21 is a top partial perspective view of the electrical connector. The differences between the present embodiment and the third embodiment are the amount and structures of the joints and signal terminals. In the present embodiment, the electrical connector 1 for reducing high frequency crosstalk interferences further includes a third joint 51, a third signal terminal 52 and a third ground terminal 43.

The third joint 51 is located under the second joint 31, mainly including a third receptacle 511 and a third ground housing 512. The third receptacle 511 is an integrally formed hollow cylinder; the third ground housing 512 is a metal cylinder covering the third receptacle 511. An end of the third signal terminal 52 is embedded in the third receptacle 511, and is bended and raised on an inner wall of the third receptacle 511. The other end of the third signal terminal 52 is connected on the mating element, such that the second ground terminal 42 is located between the first signal terminal 22, the second signal terminal 32 and the third signal terminal 52. The structure of the end of third signal terminal 52 connecting the mating element depends on the circuit distribution of the mating element, which should not be considered as a general limitation to the whole disclosure. The third ground terminal 43 is adjacent to the third signal terminal 52, with at least a part thereof in parallel to the third signal terminal 52; in addition, the third ground terminal 43 is electrically connected with the third ground housing 512 of the third joint 51.

Since every ground terminal is located adjacent to its corresponding signal terminal respectively, and also each ground terminal is located at the same side of its corresponding signal terminal, all the signal terminals are able to surround and form an area. Here the surrounded area is a triangle area 6, and one of the ground terminals is located in the triangle area 6. In the present embodiment, a first signal flow space 61 formed between the first ground terminal 41 and the first signal terminal 22 is used as the signal flow path for the first signal terminal 22. The second signal flow space 62 formed between the second ground terminal 42 and the second signal terminal 32 is used as the signal flow path for the second signal terminal 32. The third signal flow space 63 formed between the third ground terminal 43 and the third signal terminal 52 is used as the signal flow path of the third signal terminal 52.

Since the first signal flow space 61, the second signal flow space 62 and the third signal flow space 63 are independent from each other, and also the second ground terminal 42 is located between the first signal flow space 61, the second signal flow space 62 and the third signal flow space 63, the crosstalk interferences between the first signal terminal 22, the second signal terminal 32, and the third signal terminal 52 respectively are able to be further reduced.

In the previous descriptions, the fourth embodiment dispose the second ground terminal 42 between the first signal terminal 22, the second signal terminal 32 and the third signal terminal 52, which should not be considered as a general limitation to the whole disclosure. In accordance with the alignments of each signal terminal and each ground terminal, the first ground terminal 41 or the third ground terminal 43 is selectively aligned in the triangle area 6; or alternatively more than two ground terminals may be aligned in the triangle area 6. Additionally, the triangle area is only an example for the area surrounded by the signal terminals, which should not be considered as a general limitation to the whole disclosure.

A preferred application for the embodiments is an RCA connector. The advantage for the electrical connector according to the embodiments of the disclosure is to dispose a ground terminal between different signal terminals. The ground terminal may be integrally formed and connected with each of the signal joints; or multiple ground terminals may be respectively connected with their corresponding signal joints. The signal flow spaces formed between the ground terminals with each of the signal terminals may be used as signal flow paths for the first signal terminal and the second signal terminal. Here each of the signal flow spaces is independent to each other, so as to reduce the crosstalk interferences between the adjacent signal terminals during high-speed signal transmission.

While the disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical connector for reducing high frequency crosstalk interferences, adapted to be inserted with at least two mating elements, comprising:

a first joint, adapted to be inserted by one of the mating elements;

a first signal terminal, electrically connected with the mating element inserted within the first joint;

a second joint, adapted for inserting another one of the mating elements;

a second signal terminal, electrically connected with the mating element inserted within the second joint;

a third joint;

a third signal terminal, having an end located in the third joint, the ground terminal being electrically connected with the third joint and located between the first signal terminal, the second signal terminal and the third signal terminal; and a ground terminal, electrically connected with the first joint and the second joint and disposed between the first signal terminal and the second signal terminal, a signal flow space formed between the ground terminal and respectively the first signal terminal and the second signal terminal being a signal flow path for the first signal terminal and the second signal terminal respectively, wherein an area is formed between the first signal terminal, the second signal terminal and the third signal terminal, the ground terminal being located in the area.

2. The electrical connector of claim 1, wherein the first joint comprises a first receptacle and a first ground housing covering the first receptacle, an end of the first signal terminal being located in the first receptacle and raised on an inner wall of the first receptacle, the second joint comprising a second receptacle and a second ground housing covering the second receptacle, an end of the second signal terminal being located in the second receptacle and raised on an inner wall of the second receptacle.

3. The electrical connector of claim 2, wherein the ground terminal is electrically connected with the first ground housing and the second ground housing respectively.

4. The electrical connector of claim 1, wherein the third joint comprises a third receptacle and a third ground housing covering the third receptacle, an end of the third signal terminal being located in the third receptacle and raised on an inner wall of the third receptacle, the ground terminal being electrically connected with the third ground housing.

* * * * *